United States Patent [19]

Daverio et al.

[11] Patent Number: 4,890,503

[45] Date of Patent: Jan. 2, 1990

[54] METHOD FOR PROBING INSIDE A BLAST FURNACE WITH A PRESSURIZED PROBE

[75] Inventors: Jean-Claude Daverio, Ban-Saint-Martin; Dominique Rocchi, Piennes, both of France

[73] Assignee: Institut de Recherches de la Siderurgie Francaise (IRSID), Maizieres-les-Metz, France

[21] Appl. No.: 320,616

[22] Filed: Apr. 7, 1989

Related U.S. Application Data

[62] Division of Ser. No. 68,161, Jun. 30, 1987, Pat. No. 4,829,836.

[30] Foreign Application Priority Data

Jun. 30, 1986 [FR] France ..... 86 09809

[51] Int. Cl.[4] ..... G01M 19/00

[52] U.S. Cl. ..... 73/866.5; 266/45; 266/99

[58] Field of Search ..... 73/866.5, 865.9, 863.85; 266/45, 99

[56] References Cited

U.S. PATENT DOCUMENTS 4,361,315 11/1982 Kajihara et al. ..... 73/866.5 X
4,495,810 1/1985 Tessarzik et al. ..... 73/866.5
4,569,228 2/1986 Bellgert et al. ..... 73/866.5
4,742,717 5/1988 Ichino ..... 73/866.5 X
4,788,871 12/1988 Nelson et al. ..... 73/866.5
4,821,585 4/1989 Kempe ..... 73/866.5 X
4,829,836 5/1989 Daverio et al. ..... 73/866.5

*Primary Examiner*—Tom Noland
*Attorney, Agent, or Firm*—Staas & Halsey

[57] ABSTRACT

A method for implanting a tubular probe having a nose in a smelting furnace, the nose of the probe being temporarily closed off by a plug inserted therein, the plug including a substantially cylindrical body force fitted in the probe nose and an internal conduit extending through the plug. The method comprises implanting the probe into the smelting furnace; injecting a gas into the probe; controlling the flow rate of the injected gas until the probe nose has reached a required position; and regulating gas supplying pressure to keep the flow rate between a minimum value, under which furnace gas may penetrate into the probe, and a maximum value, above which the plug may be prematurely ejected. The plug may further include a head axially connected to the cylindrical body designed to cover the probe nose externally, and during the implanting step, the plug is placed on the probe so that an orifice of the internal conduit on an external face of the head is directed downwardly.

2 Claims, 1 Drawing Sheet

METHOD FOR PROBING INSIDE A BLAST FURNACE WITH A PRESSURIZED PROBE

This is a divisional of co-pending application Ser. No. 068,161 filed on 6/30/87 , and now U.S. Pat. No. 4,829,836.

FIELD OF THE INVENTION

The present invention relates to a plug for closing the nose of a probe designed to be implanted in a smelting furnace, more particularly a reducing-smelting furnace such as a blast furnace, and to a method and associated device for probing in such a furnace with a probe equipped with such a plug.

BACKGROUND OF THE INVENTION

It is already known to use probes for carrying out measurements, analyses or samplings in blast furnaces. Such probes are generally tubular, or at least comprise a tubular part at their end in order to be able to receive the measuring means or to make the required samplings.

In the case of gas samplings or pressure measurements for example, these probes can advantageously be permanently closed off at their end and have only an orifice large enough for the gases to flow through. This orifice is preferably situated on the lateral wall close to the end of the probe nose. This particular disposition reduces the risks of said orifice being accidentally damaged by the solid or liquid materials when the probe is introduced into the furnace.

If, on the contrary, such a probe is used for sampling non-gaseous materials or for example for measuring the temperature with a radiation pyrometer, situated inside the probe, it is important for the end of the probe to be free. Yet, if a tubular probe, with an open end, is introduced in a smelting furnace, hence a furnace containing high temperature materials, there is a risk for the nose of the probe to become choked up, or for the instruments inside the probe to become damaged, for example through contact with noxious or corrosive gases or through excessive temperatures.

In order to solve this problem, it has already been proposed to temporarily close off the probe nose with a plug, which is removable or ejectable by suitable means or methods when the probe nose has reached the target area. These plugs of course are not recoverable since they are ejected inside the furnace.

French Patent Application No. 2 472 018 filed by Nippon Steel Corp. describes probes equipped with such plugs. This document describes plugs which are inserted in the nose of the probe and which are removed by frictional contact with the material inside the furnace during a movement of retraction of the probe when said probe has penetrated beyond the area to be probed. This method is not completely reliable in that the plug, being removable, risks to fall off accidentally when the probe is introduced in the furnace, and this must be avoided. In reverse, if the plug is very tightly fitted in the nose, precisely to avoid accidental ejection therefrom, then such ejection may not occur at the exact spot.

It may also be necessary to protect the measuring instruments contained in the probe against the high temperatures and against possible pollution from the gases penetrating into the probe through inadequate tightness between the plug and the probe nose. To this effect, it is proposed to inject a neutral gas, such as nitrogen, inside the probe, under a certain pressure.

However, as the gas pressure inside the blast furnace in which the probe is introduced, is not necessarily known with precision, especially as it can vary, for example during the probe introduction time, the plug risks falling off if there is an excessive difference between the pressure of the gas inside the probe and the pressure inside the furnace.

The problem arising then is that of adapting the pressure of the gas injected into the probe, to the pressure inside the furnace, in order to avoid, first the infiltering into the probe of gases issued from the furnace, and second, the untimely ejection of the plug.

SUMMARY OF THE INVENTION

It is an object of the present invention to solve the aforesaid problems simply, reliably and economically.

It is another object of the invention to control the pressure of the protective gas as a function of the pressure conditions encountered inside the furnace, and which are variable and not known with precision.

A further object of the invention is to provide a device ensuring the safety of the instruments contained inside the probe, while said probe is introduced in a blast furnace, by preventing the untimely removal of the plug fitted in the probe nose.

These objects are reached with a plug for the nose of a probe implantable in a furnace such as a blast furnace, which plug is designed to temporarily seal the tubular end of said probe, and is constituted of two contiguous parts : a body, of substantially cylindrical shape so as to force-fittable in the probe nose and to have a front end face inside the probe, and a head, designed to cover the prober nose externally, and to present a free face in facing relationship to the furnace as well as a shoulder abutting on the tubular end of the probe, plug wherein a through conduit is provided therein causing the free face of the head to communicate with the front face of the body, said body being provided on its lateral wall with means ensuring tightness between it and the probe.

The invention relates to a method for implanting a tubular probe having a nose in a smelting furnace, the nose of the probe being temporarily closed off by a plug inserted therein, the plug including a substantially cylindrical body force fitted in the probe nose and an internal conduit extending through the plug. The method comprises the steps of implanting the probe into the smelting furnace; injecting a gas into the probe; controlling the flow rate of the injected gas until the probe nose has reached a required position; and regulating gas supplying pressure to keep the flow rate between a minimum value, under which furnace gas may penetrate into the probe, and a maximum value, above which the plug may be prematurely ejected. The plug may further include a head axially connected to the cylindrical body designed to cover the probe nose externally, and during the implanting step, the plug is placed on the probe so that an orifice of the internal conduit on an external face of the head is directed downwardly.

According to the invention, it is possible to introduce into a furnace a tubular probe provided at its end with a plug, and inside which is injected a protecting gas, without any risk of the plug being untimely removed.

In the case, for example, of probes containing measuring instruments, these instruments are efficiently protected by injection of a gas. Also according to the invention, ejection of the plug with subsequent damaging of the instruments due to their being over-exposed to heat radiations or to noxious gases from the furnace, is prevented.

Another advantage of the invention is that it proposes a plug which is no more expensive than the solid plugs according to the prior art, since a simple drilling operation is sufficient to make the through conduit. This advantage is a particularly determinant factor since these plugs are "consumable" elements which need renewing at every introduction of the probe into the furnace.

According to a preferred embodiment of the invention, the conduit issues onto the surface of the head, out of the axial end thereof, and follows a direction inclined with respect to the plug axis. This disposition is particularly advantageous in that on the one hand, it strongly reduces the risks of the orifice becoming clogged up with any solids or liquids which the plug may encounter while the probe is introduced in the furnace, and, on the other hand, because of the inclination of the issuing part of the conduit, no heating radiation can reach directly inside the probe, and in particular any instruments contained therein.

Moreover, the means required for carrying out the method according to the invention consist in flow control and gas pressure regulating apparatus which are currently used measuring apparatus easy to find on the market and easy to use.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
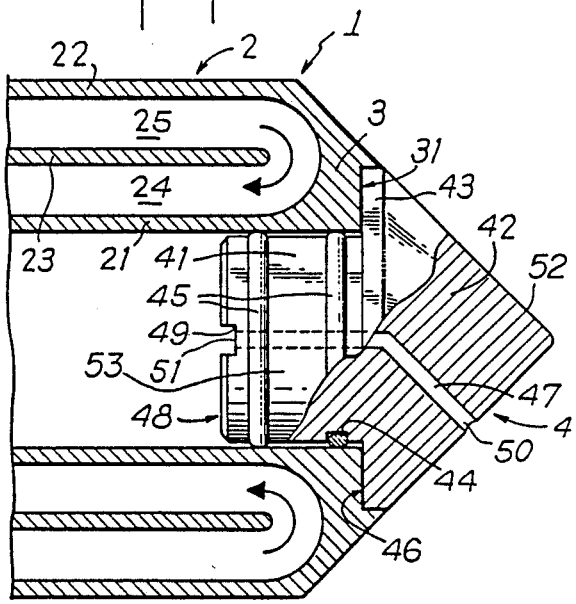
FIG. 1 is a cross-sectional view of a perforated plug according to the invention fitted in the probe nose.
Figure 2:
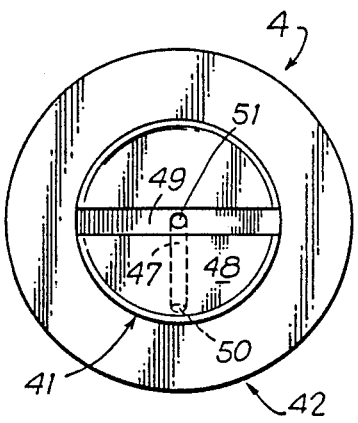
FIG. 2 is a view of the free front face of the plug body.

The probe described hereinafter is a cooled probe, more particularly designed to be used in a blast furnace, for probing operations through the blast furnace nozzles.

Such probe 1 is generally constituted of a hollow metallic tubular casing 2. Said casing comprises an internal wall 21 and an external wall 22, both of which are cylindrical and co-axial. These two walls join up at the end of the probe to form the probe nose 3. A partition 23 is provided between the external and internal walls 22 and 21, and co-axially thereto, so as to divide the space between walls 21 and 22 into two annular concentric chambers 24 and 25. The end of partition 23 on the side of nose 3, is not joined to the latter so as to leave in that area a communication between the two chambers. Spacers, not shown, keep partition 23 in a centered position with respect to the external and internal walls 22 and 21. This particular disposition creates a forced flow of probe cooling fluid (generally water) in chambers 24 and 25, as illustrated by the arrows in FIG. 1.

The probe nose comprises a recess 31, having a flat surface for the plug 4 to abut against. Said plug 4 is produced in one piece and has two contiguous parts: a cylindrical body 41 of a diameter substantially equal to the inner diameter of the probe casing 2; and a head 42, of general conical shape offering to the contact with the inside of the furnace, a face 52 which helps the penetration of the probe inside the furnace. The diameter of the head is greater than the diameter of the body, thereby forming a shoulder 46 abutting against the recess 31 of the probe nose when the plug is fitted on the end thereof. The base of the cone forms a cylindrical portion 43 of small height corresponding to the depth of the recess 31 provided on the probe nose.

The diameter of cylindrical portion 43 of the plug head (hence the maximum external diameter of the plug) is less than the external diameter of the tubular casing 2 of the probe, hence of the probe nose 3. Said diameter of the plug head is only just slightly smaller than the diameter of the recess 31 of the probe nose. This particular feature preserves a continuity between the apparent face 52 of the plug 4 and that of the nose 3, thus helping the penetration of the probe when said probe has to go through a zone of solid materials, by easing the sliding of such materials on the end of the probe.

The plug body 41 is provided on its lateral wall 53 with one or more circular grooves 44. (Two of these grooves are shown in FIG. 1). Said grooves receive joints or sealing rings 45 in a material showing adequate resistance to the high temperatures to which the plug is exposed despite the cooling of the probe. For example, said joints 45 can be made of asbestos. The plug proper is made of a heat-resistant material, such as that sold under the registered trademark "Asbestolite".

Beside their sealing function, the joints 45 also contribute, by their elasticity, to keeping the plug in position in the probe nose.

The plug is traversed through by a conduit 47 of small diameter, such as 1 or 2 millimeters, issuing onto the conical free face 52 of the head, preferably, for reasons already mentioned, according to an inclined direction with respect to the axis of the plug, and substantially towards the middle of a generatrix of said conical part via an orifice 50. The other end of internal conduit 47 issues onto the free front face 48 of body 41 opposite the inside of the probe, via an orifice 51 advantageously situated in a groove 49 formed transversely into said face diameterwise. This particular feature of the invention prevents any obstruction of the orifice should an object contained inside the probe move against the front face 48 of the plug body. In this case, due to the groove 49, a free passage is preserved through the diametrically opposite ends of said groove, since the objects normally placed inside the probe do not occupy the full internal section thereof.

Figure 3:
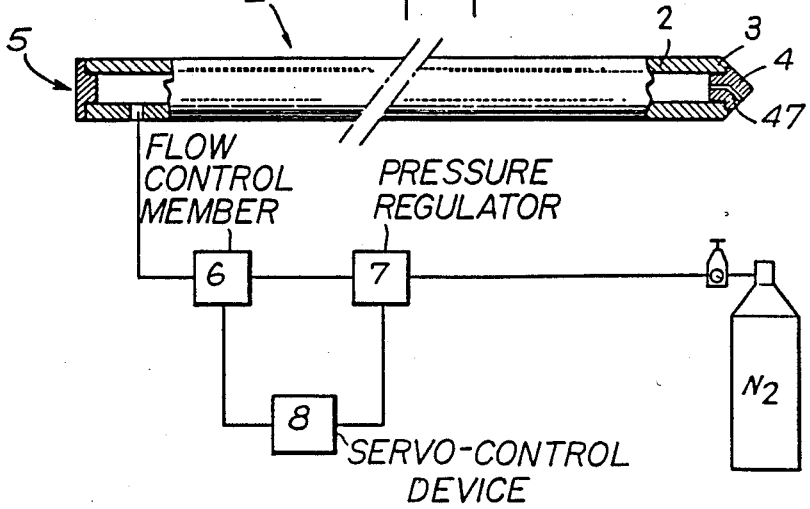
FIG. 3 is a schematic illustration of the device used for carrying out the furnace probing method.

The implantation of a probe in a blast furnace will now be described with reference to FIG. 3, and more particularly, the implantation of a parietal probe through the tuyere of a blast furnace, in such a way as to bring the end of the probe in the central stack of coke, normally called the "dead-man". This operation, which is delicate since carried out in a very hot part of the furnace, implies during the penetration, the passage of the probe nose through zones of very different characteristics. In such a case, the probe first goes through a gaseous zone at the level of the tuyere and of the blast furnace whirling cavity, then a solid zone at the level of the "dead-man". The probe nose must be capable of withstanding the various stresses resulting from its encounter with such a variety of materials.

To this effect, the plug should be particularly carefully designed. Its shape should contribute to making the penetration of the probe easier. It should be able to seal the probe efficiently throughout its introduction, and until such time as it is ejected by the appropriate means.

When the probe nose traverses a gaseous zone of the furnace, the strain exerted on the plug is caused by the difference between the pressure inside the furnace and the pressure of the gas injected into the probe according to the invention, and according to which it is possible to assess said pressure difference and to adjust the supply of protective gas accordingly.

Typically, the probe is introduced as described hereinafter. The probe 1 is equipped with a plug 4 perforated according to the invention and contains the instruments necessary to carry out the required measurements or samplings. A pressurized gas, preferably a neutral gas, and advantageously nitrogen, is introduced in the probe close to its end 5 opposite the nose 3, via a flow control member 6 and a pressure regulator 7.

Then the probe is introduced into the blast furnace through the tuyere, and through conventional tightness means, so as to prevent any escape of the pressurized gas from the blast furnace into the atmosphere.

Care must be taken to fit the plug 4 so that its orifice 50 faces downwardly before the introduction of the probe, and to preserve this orientation throughout the penetration period, in order to avoid obstruction, should solid or liquid materials accidentally fall on the probe nose.

Once the probe nose is in contact with the gas inside the blast furnace, the plug is subjected, first to the pressure of that gas which tends to keep it applied against the probe, and second to the pressure of the nitrogen which tends to eject it. The plug, being force-fitted in the probe nose, can withstand a certain differential pressure which tends to push it off. Moreover, since it is important to prevent the gas from the blast furnace from penetrating into the probe, it is necessary to keep the pressure of the nitrogen higher than that of the gas inside the blast furnace. The invention resides in the fact that this is achieved simply by keeping a minimum flow of nitrogen through the conduit 47 of the plug 4. This flow is controlled by the flow controlling member 6. If the flow increases, it means that the pressure inside the blast furnace reduced, consequently the pressure of the nitrogen will be reduced in order to keep a balance. In reverse, if the flow reduces, it means that the pressure inside the blast furnace increases, then the pressure of the nitrogen will be increased accordingly.

In practice, a range of values is used for the flowrate, which is determined by a maximum above which the plug risks to be pulled off, and a minimum under which the gas from the blast furnace risks to penetrate into the probe.

This minimum is not zero in order to prevent uncontrolled leaks of nitrogen, and especially because, if the pressure did increase inside the furnace, the nitrogen contained in the probe would compress and would allow the gas from the blast furnace to penetrate through conduit 47.

Considering that the maximum flow corresponds to a maximum pressure difference acceptable between the inside of the probe and the furnace, in order to keep the plug on the probe nose, it is possible to use the above-described device for ejecting the plug at the end of the penetration operation by deliberately increasing the pressure above the limits previously set for the introduction operation.

The nitrogen pressure regulator 7 can advantageously be adjusted as a function of the flow control member 6, by means of a servo-control device 8 which will automatically adjust the pressure as a function of the flow.

The invention is advantageously applicable to all types of probings performed with a tubular probe in a furnace containing pressurized gases.

The invention is in no way limited to the description given hereinabove and on the contrary covers any modifications that can be brought thereto without departing from the scope of protection defined in the accompanying claims.

What is claimed is:

1. A method for implanting a tubular probe having a nose in a smelting furnace, the nose of said probe being temporarily closed off by a plug inserted therein, the plug including a substantially cylindrical body force fitted in the probe nose and an internal conduit extending through the plug, said method comprising the steps of:

implanting the probe into the smelting furnace;

injecting a gas into the probe;

controlling the flow rate of the injected gas until the probe nose has reached a required position; and regulating gas supplying pressure to keep the flow rate between a minimum value, under which furnace gas may penetrate into the probe, and a maximum value, above which the plug may be prematurely ejected.

2. A method as claimed in claim 1, wherein the plug further includes a head axially connected to the cylindrical body designed to cover the probe nose externally, an during said implanting step the plug is placed on the probe so that an orifice of the internal conduit on an external face of the head is directed downwardly.

* * * * *